US010975634B2

(12) United States Patent
Doran et al.

(10) Patent No.: US 10,975,634 B2
(45) Date of Patent: Apr. 13, 2021

(54) TUBING GUIDE STABILIZATION

(71) Applicant: National Oilwell Varco, L.P., Houston, TX (US)

(72) Inventors: Marcus Joseph Doran, Arlington, TX (US); Timothy Scott Steffenhagen, Fort Worth, TX (US); Antonio Ruiz, Fort Worth, TX (US); Kevin Edwin AuBuchon, Fort Worth, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 140 days.

(21) Appl. No.: 16/131,291

(22) Filed: Sep. 14, 2018

(65) Prior Publication Data

US 2019/0085646 A1 Mar. 21, 2019

Related U.S. Application Data

(60) Provisional application No. 62/560,439, filed on Sep. 19, 2017.

(51) Int. Cl.
*E21B 19/08* (2006.01)
*E21B 19/22* (2006.01)

(52) U.S. Cl.
CPC ..... *E21B 19/08* (2013.01); *E21B 19/22* (2013.01)

(58) Field of Classification Search
CPC ..... E21B 19/22; E21B 19/08; E21B 17/20
See application file for complete search history.

(56) References Cited

U.S. PATENT DOCUMENTS 4,585,061 A * 4/1986 Lyons, Jr. ..... E21B 19/22 166/77.3
5,799,731 A * 9/1998 Avakov ..... E21B 19/22 166/77.2
6,681,614 B1 1/2004 Riffe
(Continued)

FOREIGN PATENT DOCUMENTS

CA 3017404 3/2019
GB 2568154 5/2019
(Continued)

OTHER PUBLICATIONS

"United Kingdom Application Serial No. 1815273.6, Search Report dated Feb. 28, 2019", 6 pgs.
(Continued)

*Primary Examiner* — Catherine Loikith
(74) *Attorney, Agent, or Firm* — Schwegman Lundberg & Woessner, P.A.

(57) ABSTRACT

The present disclosure relates to novel and advantageous devices, systems, and methods for stabilizing a coiled tubing guide extending from a coiled tubing unit. Stabilization of the guide may mitigate movement of the guide from lateral operational forces. The guide may be stabilized by clamping or anchoring a connection point between the guide and the unit, such as between the guide and a coiled tubing injector frame or a tubing guide mount coupled to the coiled tubing injector frame. In general, a clamp or other mechanism may operate to preload the pinned connection with a prescribed force. The direction of the force may be perpendicular, or near perpendicular, to an axis of rotation about which lateral loading on the guide causes moment forces.

20 Claims, 10 Drawing Sheets

(56) References Cited

U.S. PATENT DOCUMENTS

| | | | | |
|---|---|---|---|---|
| 7,036,578 | B2 * | 5/2006 | Austbo | E21B 19/22 166/77.2 |
| 9,464,493 | B2 * | 10/2016 | Andreychuk | E21B 17/20 |
| 2004/0211555 | A1 | 10/2004 | Austbo et al. | |
| 2006/0096754 | A1 | 5/2006 | Weightmann | |
| 2006/0163415 | A1 | 7/2006 | Geddes et al. | |
| 2008/0173480 | A1 | 7/2008 | Annaiyappa et al. | |
| 2013/0048270 | A1 | 2/2013 | Havinga et al. | |
| 2014/0000867 | A1 | 1/2014 | Andreychuk et al. | |
| 2014/0174194 | A1 | 6/2014 | Wu | |
| 2015/0101799 | A1 | 4/2015 | Steffenhagen et al. | |
| 2016/0138347 | A1 | 5/2016 | Bjornenak | |
| 2016/0369614 | A1 | 12/2016 | Turner et al. | |
| 2017/0006878 | A1 | 1/2017 | Domenicucci et al. | |
| 2017/0260835 | A1 | 9/2017 | Crawford et al. | |
| 2018/0320502 | A1 * | 11/2018 | Turner | E21B 47/0006 |
| 2019/0062068 | A1 | 2/2019 | Kreisfeld et al. | |

FOREIGN PATENT DOCUMENTS

| | | | |
|---|---|---|---|
| SG | 10201808078 | W | 4/2019 |
| WO | WO-2009044117 | A1 | 4/2009 |
| WO | 2017105411 | | 6/2017 |
| WO | WO-2020060998 | A1 | 3/2020 |
| WO | WO-2020131621 | A1 | 6/2020 |
| WO | WO-2020223502 | A1 | 11/2020 |

OTHER PUBLICATIONS

"International Application Serial No. PCT/US2020/030755, International Search Report dated Aug. 4, 2020", 2 pgs.
"International Application Serial No. PCT/US2020/030755, Written Opinion dated Aug. 4, 2020", 7 pgs.
"International Application Serial No. PCT/US2019/051443, International Search Report dated Nov. 13, 2019", 2 pgs.
"International Application Serial No. PCT/US2019/051443, Written Opinion dated Nov. 13, 2019", 5 pgs.
"International Application Serial No. PCT/US2019/066238, International Search Report dated Mar. 25, 2020", 5 pgs.
"International Application Serial No. PCT/US2019/066238, Written Opinion dated Mar. 25, 2020", 5 pgs.
"United Kingdom Application Serial No. 1815273.6, Response filed Sep. 17, 2019 to Search Report dated Feb. 28, 2019", 21 pgs.

* cited by examiner

TUBING GUIDE STABILIZATION

CROSS-REFERENCE TO RELATED APPLICATIONS

The present application claims priority to U.S. Provisional Application No. 62/560,439, filed on Sep. 19, 2017, entitled Tubing Guide Stabilization, the content of which is hereby incorporated by reference herein in its entirety.

FIELD OF THE INVENTION

The present disclosure relates to coiled tubing units. Particularly, the present disclosure relates to coiled tubing guides for directing tubing into coiled tubing injectors. More particularly, the present disclosure relates to devices, systems, and methods for stabilizing a tubing guide to mitigate angular offset of tubing entering a coiled tubing injector.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Coiled tubing refers to a continuous string of pipe coiled on a take-up reel for transportation and handling. Coiled tubing is provided with outer diameters ranging from 0.75 inches to 4 inches, and may be used in a wide range of oilfield services and operations throughout the life of a well. A coiled tubing unit may be a mobile or stationary vehicle or structure for performing coiled tubing operations at a well. A coiled tubing unit may often have a coiled tubing injector. The injector may drive or guide the tubing into a well for performing various oilfield services or operations. The coiled tubing unit may additionally have a coiled tubing guide, which may generally direct the tubing, as it is unspooled from a reel, into the injector. In general, the guide may help to mitigate bends or kinks in the continuous tubing before it is fed into the injector.

During operation of the coiled tubing unit, the coiled tubing guide may experience lateral forces. For example, due to its coiled nature and the width of the reel, the tubing may feed into the tubing guide at differing angles, as the tubing is uncoiled from the reel. These angles combined with the tension force of the reel, weight and stiffness of the tubing, and/or any rig up misalignment may cause lateral loads on the tubing guide. This lateral loading may cause movement of the tubing guide and/or other components of the coiled tubing unit, which may in turn cause the tubing to enter and/or exit the injector at an offset angle. Passing the tubing through the injector at offset angles can lead to a variety of problems. For example, the angular offset of the tubing can lead to excess wear on, or damage to, drive bearings, traction cylinders, bushings, chains, and/or other components of the injector. In some cases, this can lead to damage to the tubing, itself, directly or from continued operation of the injector with damaged or failed chain components, inserts, or other components. Damage to the tubing can shorten its life, in some cases can render the tubing inoperable, and may cause potentially unsafe operating conditions. If one or more components of a tubing injector fails, the tubing line may need to be cut and/or removed from the well. In some cases, this can lead to relatively high costs in both time and money, as well operations may be stalled while components are repaired or replaced.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a coiled tubing unit for servicing an oil well. The unit may include a coiled tubing injector and a coiled tubing guide arranged proximate to the injector. The coiled tubing guide may be configured to direct tubing from a reel and into the injector. Moreover, the coiled tubing guide may be coupled to the unit by a pinned connection with a pin extending laterally relative to a line of motion of the tubing. The unit may additionally have a clamping mechanism arranged and configured to apply a load on the pinned connection to reduce play in the pinned connection. In some embodiments, the coiled tubing guide may have a sleeve configured to receive the pin, and the clamping mechanism may be configured to apply a load on the sleeve. The clamping mechanism may include a plate spring in some embodiments. In other embodiments, the clamping mechanism may include a clamping plate and a tensioning handle pivotably coupled to the clamping plate. The plate spring may be anchored at a first end, and may be coupled at a second end to the tensioning handle. In some embodiments, the clamping mechanism may include a threaded clamp. In some embodiments, the coiled tubing injector may be arranged in an injector frame, and the coiled tubing guide may be coupled by the pin to a tubing guide mount arranged on the injector frame. In some embodiments, the clamping mechanism may include a spring, a clamp, a belt, a cable, a cam, a lever, and/or a pair of bumpers.

The present disclosure, in one or more embodiments, additionally relates to a method of reducing lateral movement of a coiled tubing guide, wherein the coiled tubing guide is coupled to a coiled tubing unit by a pinned connection with a pin extending laterally relative to a line of motion of tubing being directed through the tubing guide. The method may include positioning a clamping mechanism over the pinned connection so as to apply a load on the pinned connection to reduce play in the pinned connection. In some embodiments, the method may include positioning a plate spring over the pinned connection, coupling the plate spring to a clamp, and tightening the clamp to apply a force to the pinned connection. The pinned connection may include a pin arranged through a sleeve of the tubing guide, and the plate spring may be arranged over the sleeve. In some embodiments, the clamping mechanism may include a plate spring, a clamping plate, and a tensioning handle pivotably coupled to the clamping plate. In other embodiments, the clamping mechanism may include a plate spring and a threaded clamp.

The present disclosure, in one or more embodiments, additionally relates to a clamping mechanism for reducing lateral movement of a coiled tubing guide, wherein the coiled tubing guide is coupled to a coiled tubing unit by a pinned connection with a pin extending laterally relative to a line of motion of tubing being directed through the tubing guide. The mechanism may include a spring extending over the pinned connection and a clamp coupled to the spring and configured to tighten the spring so as to apply a load on the pinned connection to reduce play in the pinned connection. In some embodiments, the coiled tubing guide may include a sleeve configured to receive a pin, and the clamping mechanism may be configured to apply a load on the sleeve. In some embodiments, the spring may be a plate spring. The clamp may include a clamping plate and a tensioning handle pivotably coupled to the clamping plate. In other embodiments, the clamp may include a threaded clamp. Moreover, the spring may be anchored at a first end by an anchoring pin and may be coupled at a second end to the clamp.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous devices, systems, and methods for stabilizing a coiled tubing guide extending from a coiled tubing unit. Stabilization of the guide may mitigate movement of the guide from lateral operational forces. The guide may be stabilized by clamping or anchoring a connection point between the guide and the unit, such as between the guide and a coiled tubing injector frame or a tubing guide mount coupled to the coiled tubing injector frame. In general, a clamp or other mechanism may operate to preload the pinned connection with a prescribed force. The direction of the force may be perpendicular, or near perpendicular, to an axis of rotation about which lateral loading on the guide causes moment forces. Clamping or anchoring the connection between the guide and the coiled tubing unit may generally prevent or mitigate lateral or rotational movement of the tubing guide, which may prevent or mitigate angular offset of tubing entering the injector. The tubing guide may have a sleeve configured to receive a pin at the pinned connection. A plate spring may extend around a portion of the sleeve at the connection between the tubing guide and the coiled tubing unit. The plate spring may be configured to apply a force on the sleeve of the guide and/or on the pin within the sleeve. The plate spring may be tensioned using one or more of a variety of clamping or anchoring mechanisms. For example, a latch of a tensioning handle may be pushed down to engage one or more ridges or teeth of a clamping plate. In other embodiments, threading on a screw clamp may be engaged to tension the plate spring. In some embodiments, a threaded bolt may be tightened to tension the plate spring. In other embodiments, other mechanisms may be used to tension the plate spring about the guide sleeve. In still other embodiments, other mechanisms may be used to apply a preloading force across the pinned connection.

Figure 1:
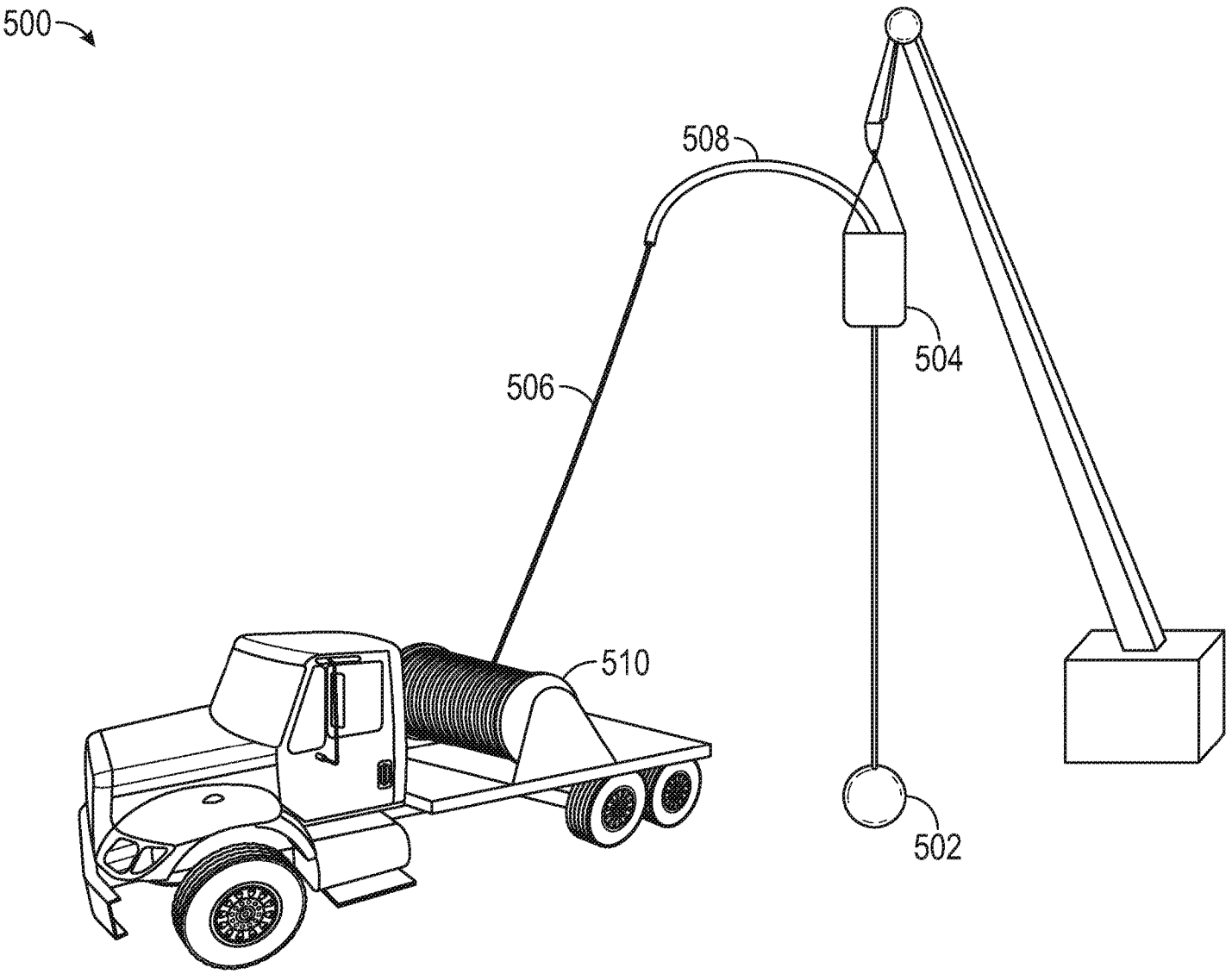
FIG. 1 is a conceptual view of a coiled tubing unit of the present disclosure, according to one or more embodiments.

Turning now to FIG. 1, a coiled tubing unit 500 of the present disclosure is shown, according to one or more embodiments. The unit 500 may be arranged about a well 502. The unit 500 may include a coiled tubing injector 504 arranged over the well 502 to drive coiled tubing 506 into the well. A coiled tubing guide 508 may be arranged proximate to the injector 504. For example, the tubing guide 508 may be coupled to a frame surrounding the injector 504 in some embodiments. The coiled tubing guide 508 may be configured to receive tubing 506 as it is unspooled from a reel 510, and direct the tubing toward or into a top of the injector 504. The tubing guide 506 may generally help to mitigate bends or kinks in the unspooled tubing 506, as well as lateral forces due to tension across the width of the reel 510. The tubing guide 506 may additionally help manage a bend radius of the tubing 506 as it enters the injector 504.

Figure 2:
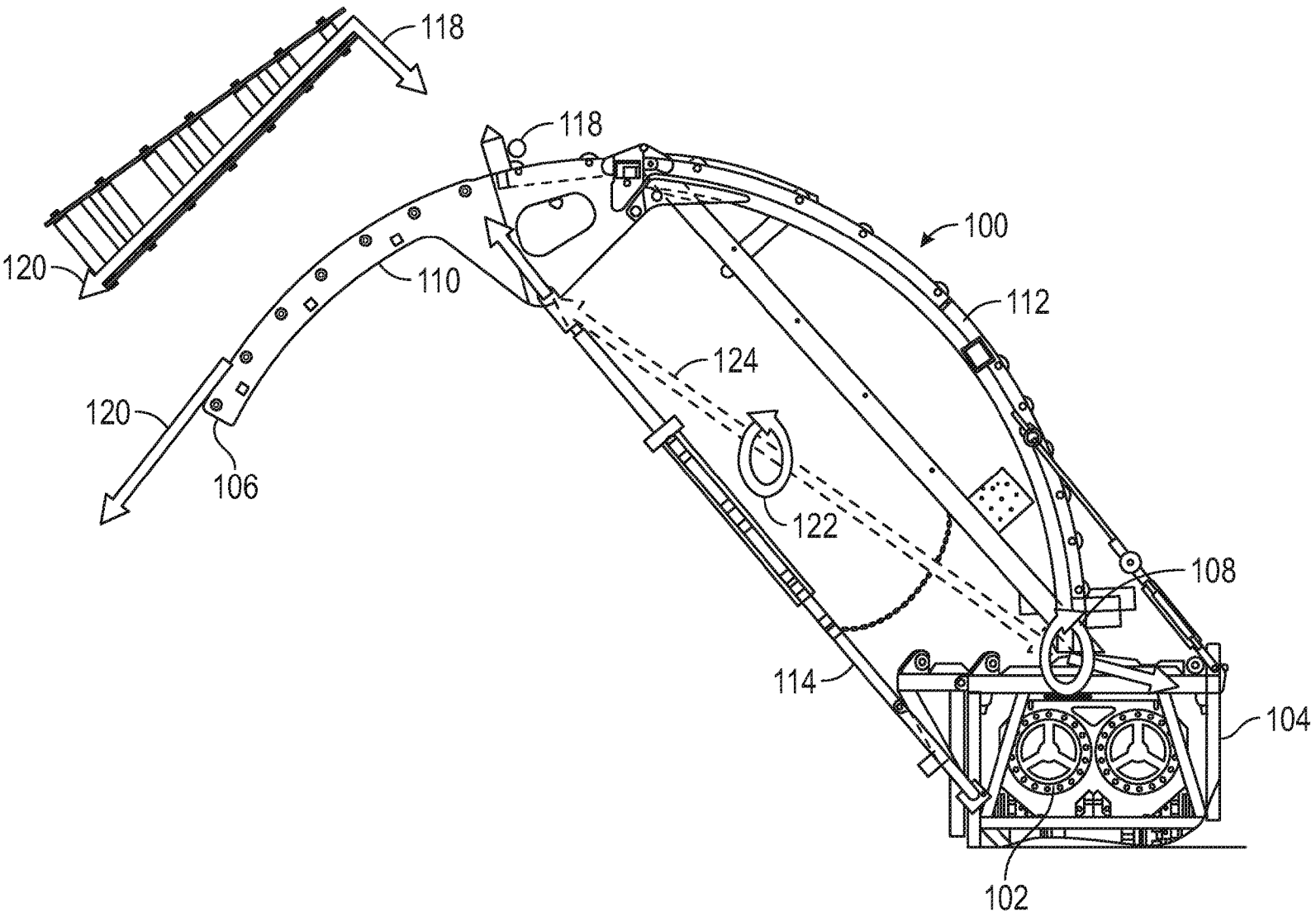
FIG. 2 is a side view of a coiled tubing guide couple to a coiled tubing injector frame, according to one or more embodiments.

Turning now to FIG. 2, a coiled tubing guide 100 according to one or more embodiments is shown. The coiled tubing guide 100 may be arranged on a mobile or stationary coiled tubing unit. The tubing guide 100 may generally extend proximate to a coiled tubing injector 102. For example, in some embodiments, the injector 102 may be arranged within or beneath an injector frame 104, and the guide 100 may be coupled to the injector frame, via a tubing guide mount for example. The guide 100 may have an arced or semi-circular shape with any suitable radius of curvature. The guide may be configured to mitigate bends or kinks in the tubing as it is uncoiled from a reel, for example, and fed toward the injector 102. The guide 100 may be configured to feed or direct the tubing into a top of the injector 102, for example. The guide 100 may be configured to receive a line of tubing at a first end, or receiving end 106, of the arced guide. The tubing may pass through the guide 100, and may be fed to the injector 102 through a second end, or injector end 108, of the arced guide. In some embodiments, the guide 100 may have multiple segments, such as two segments, to allow for more compact transportation of the guide. For example, first 110 and second 112 segments may be coupled by a hinged connection in some embodiments. A strut 114 may extend between the guide 100 and the frame 104 to support the guide as tension from the coiled tubing applies bending forces on the guide.

Figure 3:
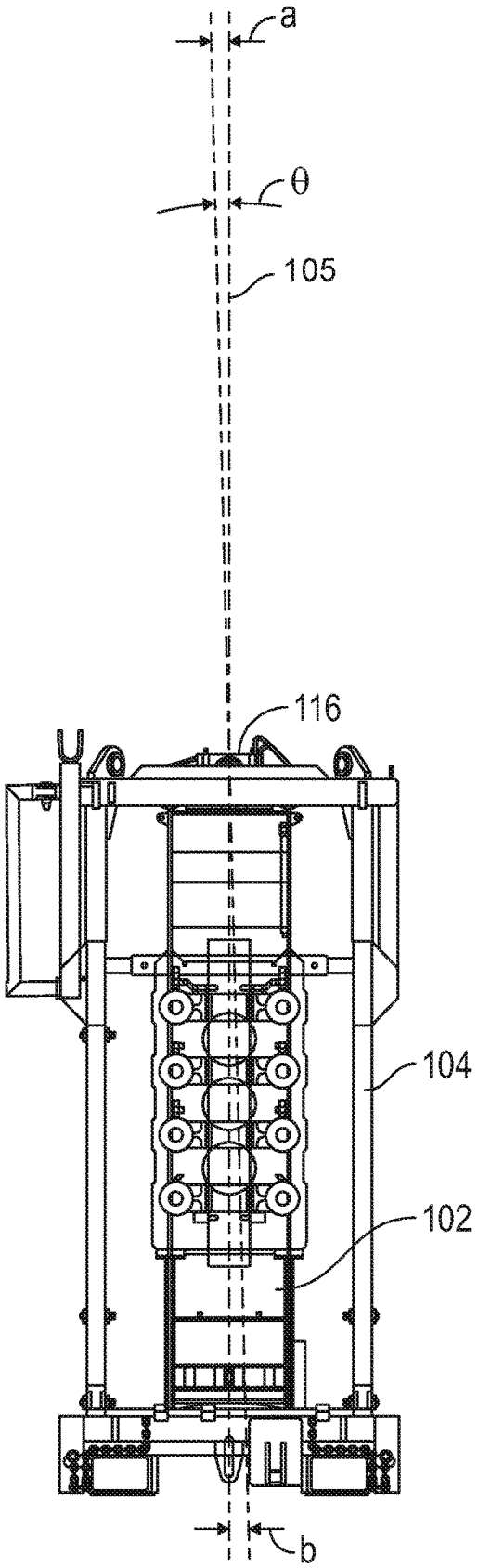
FIG. 3 is a cross sectional view of a coiled tubing injector, according to one or more embodiments.

FIG. 3 illustrates a cross sectional view of the injector 102 and injector frame 104. As described above, problems can arise when the tubing is fed through the injector 102 at an angle offset from center. Even a small offset angle of less than 1 degree can damage or cause excess wear on injector components. For example, FIG. 3 illustrates a centerline 105 of a tubing guide arranged proximate to the injector 102. If tubing passes through the guide, or a portion of the guide, at an angle .theta. from center prior to entering the injector, such as due to movement of the guide, this may cause the tubing to move through the injector 102 and exit the injector at the same or a similar angle. Even a small offset "a" of a few inches or less may cause angular offset throughout the injector 102 and offset "b" upon exiting the injector. As additionally shown in FIG. 3, a pin 116 may couple the injector end 108 of the guide 100 to a tubing guide mount on the injector frame 104, or to another suitable structure or surface of the coiled tubing unit, so as to position the guide over the injector 102 to direct tubing into a top of the injector. In some embodiments, the pinned connection may allow the guide 100 to pivot about the connection, such as during setup and takedown of the coiled tubing unit. In other embodiments, multiple pins and/or other mechanisms may be used to couple the guide 100 to the injector frame 104 or other component of the unit.

As described above, tubing operations may cause lateral forces to act on the guide 100. A lateral force 118, as well as a longitudinal force 120 caused by tension of the coiled tubing reel and weight of the tubing is shown for example in FIG. 2. In some cases, the lateral forces 118 may cause a moment force 122 on the tubing guide 100 about an axis 124 spanning between the pin 116 and the connection between the guide and the strut 114. Other or additional forces on the guide 100, frame 104, tubing guide mount, injector 102, pin 116, or other unit components may be caused by operations as well. These lateral and rotational forces may cause movement of the pin 116 and/or movement of the guide 100 at the location of the pin connection.

Figure 10:
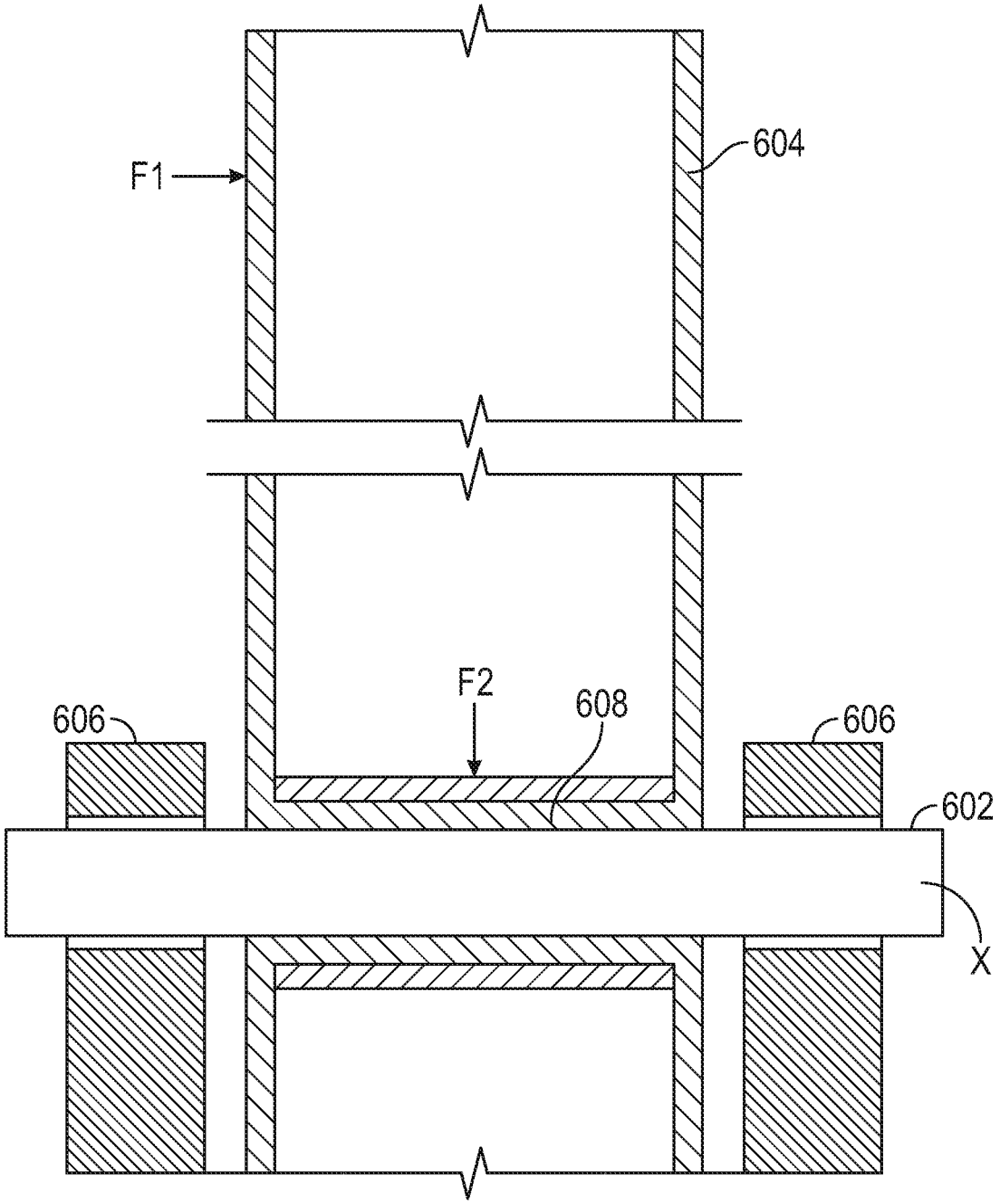
FIG. 10 is a free body diagram of a pinned connection between a coiled tubing guide and a tubing guide mount, according to one or more embodiments.

Turning to FIG. 10, for example, a free body diagram of the pinned connection is shown, according to one or more embodiments. As shown in FIG. 10, a pin 602 may be arranged through a tubing guide 604 and a tubing guide mount 606 arranged on an injector frame. The tubing guide 604 may have a sleeve 608 configured to receive the pin 602. Lateral force $F_1$, which may occur during coiled tubing operations as described above, may tend to cause rotation of the tubing guide 604 and pin 602 about point x. Due to play or space in bushing/bearing connections between the pin 602 and the sleeve 608, between the guide 604 and the mount 606, and/or between the pin and the mount, the moment forces may cause movement of the guide and/or movement of the pin. This may lead to angular offset of coiled tubing that is directed from the guide 604 into a tubing injector.

This movement of the pin 602 and/or movement of the guide 604 at or near the pinned connection may be reduced or mitigated by preloading the pinned connection. For example, the sleeve 608 may be anchored using one or more clamping or other mechanisms to apply a force $F_2$ to the sleeve and to the pin perpendicular, or near perpendicular, to the axis of rotation of the guide 604 and pin 602 about point x. This preloading, or anchoring, of the pinned connection may generally eliminate or reduce slack or play at the pinned connection, to reduce or mitigate movement of the pin 602 and/or guide 604 that may otherwise result from operational forces, including lateral forces on the tubing guide. By mitigating movement at the pinned connection, both the pin 602 and guide 604 may experience reduced movement from lateral operational forces, and the guide may better position tubing to enter the injector along a centerline, or otherwise at a desired angle of insertion. A variety of different mechanisms may be used alone or in combination to preload the pinned connection or otherwise reduce movement at the pinned connection between the guide 604 and mount 606. The mechanisms may be configured to operably apply the force $F_2$ to the pinned connection after assembly of the coiled tubing unit, and may be removed for disassembly. In this way, the components of the pinned connection may be freely movable until application of the clamping force. The mechanism(s) may be configured to apply the force $F_2$ continuously during tubing operations.

Figure 4:
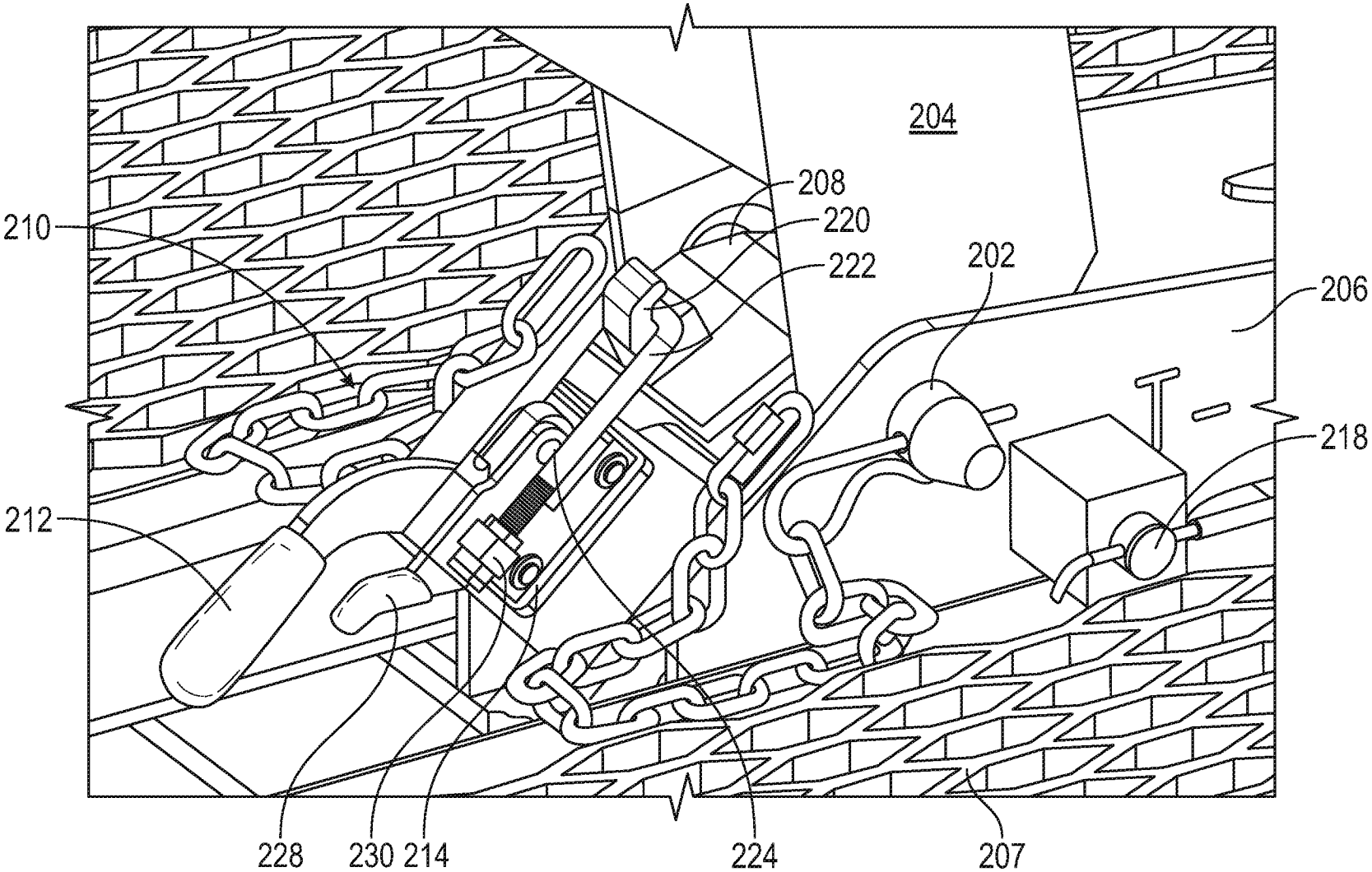
FIG. 4 is a perspective view of a clamping mechanism at a pinned connection between a coiled tubing guide and a tubing guide mount, according to one or more embodiments.
Figure 5:
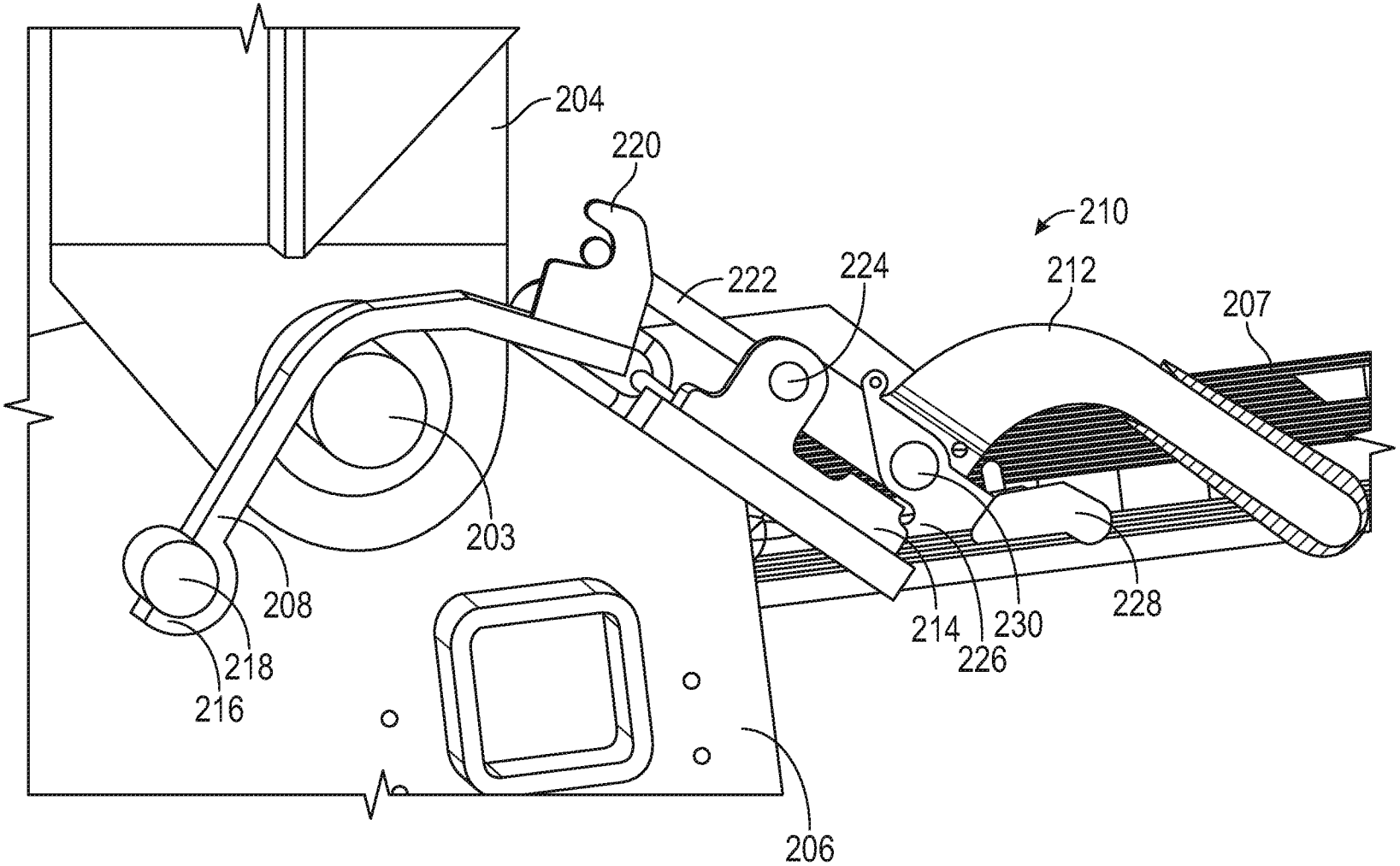
FIG. 5 is a cross sectional view of the clamping mechanism of FIG. 4, according to one or more embodiments.

FIGS. 4 and 5 illustrate one example of a mechanism for preloading the pin, according to one or more embodiments. As shown in FIGS. 4 and 5, a pin 202 may operate to connect a tubing guide 204 to a tubing guide mount 206 arranged on a tubing guide injector frame 207, or alternatively to another structure or surface proximate to the tubing injector. As shown in FIG. 5, the tubing guide 204 may have a sleeve 203 configured to receive the pin 202. In some embodiments, a bushing may be arranged between the pin 202 and sleeve 203 and/or between the pin and tubing guide mount 206. A plate spring 208 may be configured to preload the pinned connection by extending around the sleeve 203 to reduce or resist play or excess movement in the pinned connection. A clamp 210 having a tensioning handle 212 and a clamping plate 214 may operate to load the plate spring.

The plate spring 208 may generally have a flattened plate-like shape and may be configured to curve around a portion of the sleeve 203 to effectively withstand rotational forces on the pin 202 and guide 204 caused by coiled tubing operations. The plate spring 208 may generally have any suitable size. The spring 208 may be composed of steel or another suitable metal or metal alloy. In some embodiments, a bushing may be arranged between the spring 208 and the sleeve 203. The bushing may help to increase contact area between the spring 208 and sleeve 203, and may additionally help distribute loading from the spring to the sleeve. Additionally, the bushing may be configured to reduce friction between the sleeve 203 and spring 208, so as to mitigate or prevent the spring from applying a torque on the sleeve. The spring 208 may couple to the tubing guide mount 206, or another suitable surface, at a first end, which may be an anchoring end 216. In some embodiments, the anchoring end 216 may removably or fixedly couple to the mount 206 via an anchoring pin 218. For example, the anchoring end 216 may have a curved profile configured to engage the anchoring pin 218 such that the spring 208 may leverage against the anchoring pin as it is loaded by the clamp 210. At an opposing end of the spring 208, a hook or catch 220 may allow for attachment of the clamp 210. For example, the hook or catch may be configured to receive a loop or ring 222 coupled to the clamp 210.

Figure 6:
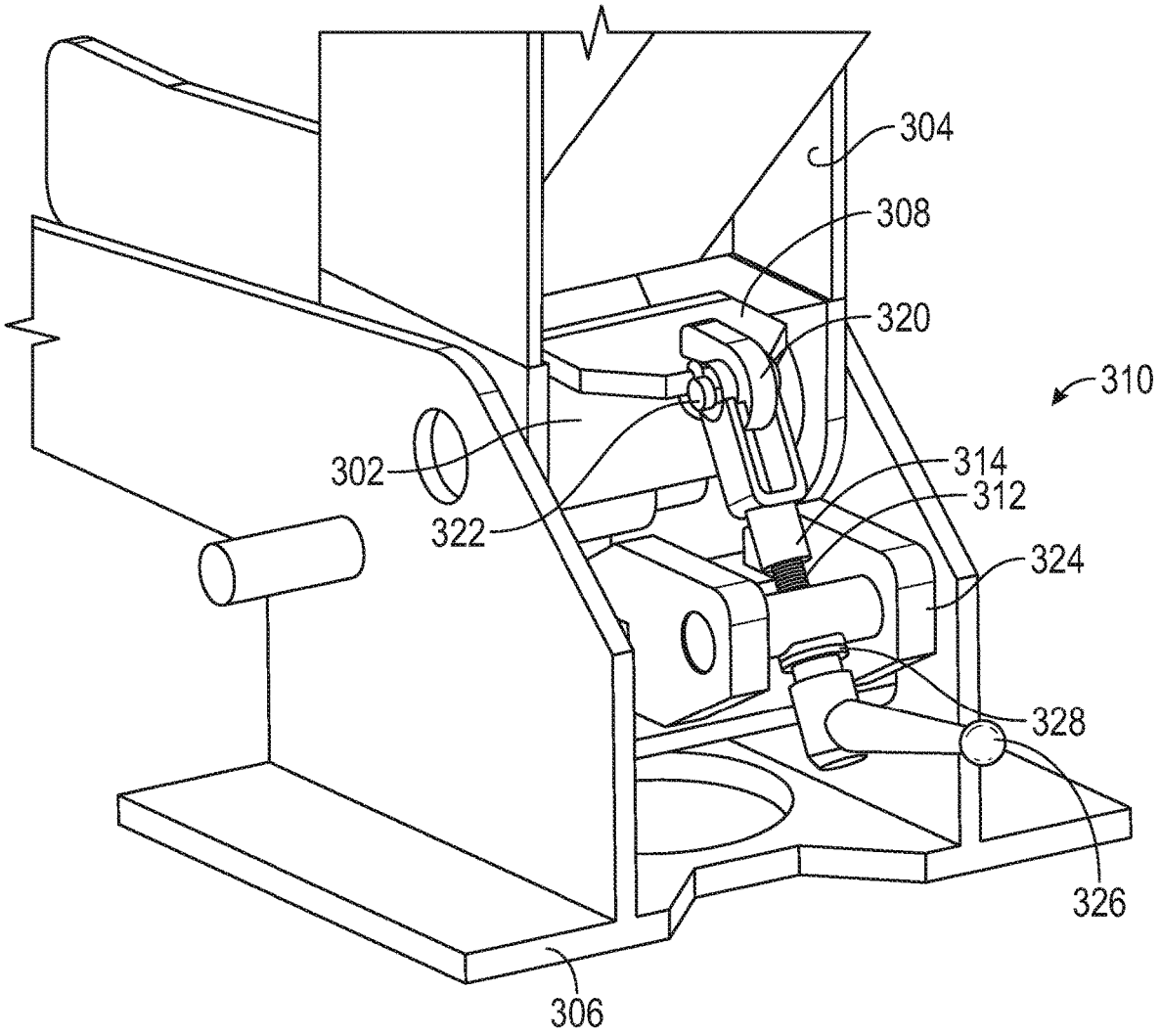
FIG. 6 is a perspective view of a clamping mechanism at a pinned connection between a coiled tubing guide and a tubing guide mount, according to one or more embodiments.
Figure 7:
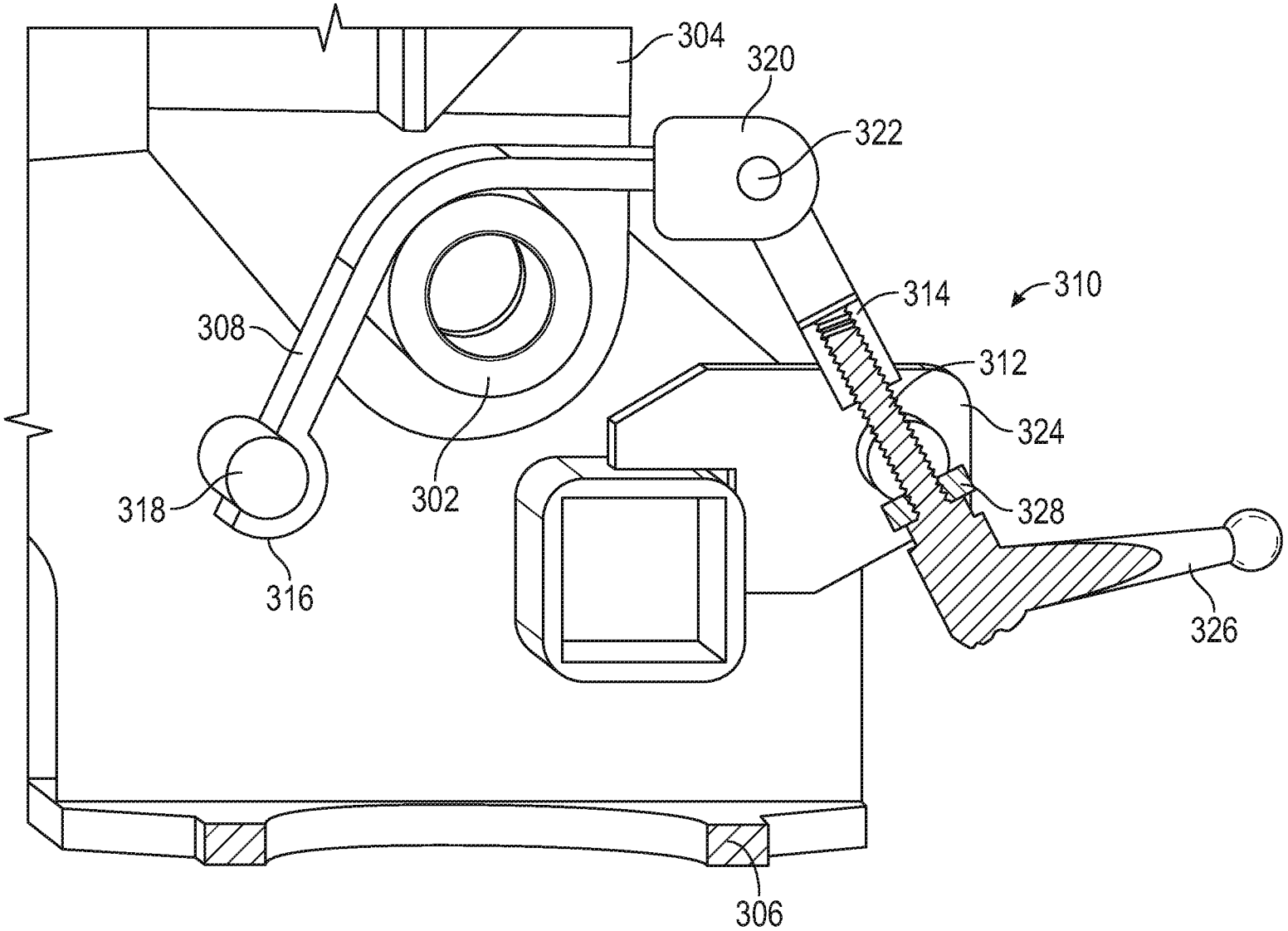
FIG. 7 is a cross sectional view of the clamping mechanism of FIG. 6, according to one or more embodiments.

The clamp 210 may have a tensioning handle 212 and a clamping plate 214, and may be configured to pull or push the spring 208 around the sleeve 203 to apply a force to the pin. The clamping plate 214 may be arranged on the tubing guide mount 206 or any other suitable structure or surface. The clamping plate 214 may have one or more ridges or teeth (not shown) configured to engage with the tensioning handle 212. In this way, the ridges may lock the tensioning handle 212, and the spring 208, in a fixed, loaded position. The tensioning handle 212 may be pivotably coupled to the clamping plate 214 at a pivot point 224, and may be configured to allow an operator to load the spring 208 by pushing or pulling on the handle. The tensioning handle 212 may have a latch 226 configured to latch onto the one or more ridges of the clamping plate 214. As described above, the ring or loop 222 may extend between the catch 220 and the tensioning handle 212, such that as the tensioning handle is pushed or pulled about the pivot point 224, the ring may operate to pull on the catch to load the spring 208. The latch 226 may latch onto the one or more ridges of the clamping plate 214 to lock the handle 212 and spring 208 in place. In some embodiments, the latch 226 may be pivotably coupled to the tensioning handle 212, and may have a release handle 228. The release handle 228 may allow an operator to pivot the latch 226 about its pivot point 230 to release the clamp 210. In other embodiments, other suitable mechanisms may be used to release the clamp 210. Moreover, in some embodiments, the clamping plate 214 may have a plurality of ridges or positions with which the latch 226 may engage, such that the clamp 210 may be adjusted to provide a desired loading or tensioning of the spring 208. Turning now to FIGS. 6 and 7, another mechanism for preloading the pin is shown, according to one or more embodiments. As similarly described with respect to FIGS. 4 and 5, a pin may operate to connect a tubing guide 304 to a tubing guide mount 306, or alternatively to another structure or surface proximate to the tubing injector. The tubing guide 304 may have a sleeve 302 configured to receive the pin. A plate spring 308 may be configured to preload the sleeve 302 and/or pin to reduce or resist play or excess movement at the pinned connection. A clamp 310 having an insertion portion 312 and a receiving portion 314, and may operate to load the plate spring 308. In some embodiments, a bushing may be arranged between the spring 208 and the sleeve 203. Moreover, a wear pad may be arranged between the spring 208 and the sleeve 203, or between the spring 208 and the bushing.

The plate spring 308 may be similar to the plate spring described with respect to FIGS. 4 and 5. That is, the plate spring 308 may generally have a flattened plate-like shape and may be configured to curve around a portion of the sleeve 302 to effectively withstand rotational forces on the pin and/or guide 304 caused by coiled tubing operations. The spring 308 may couple to the tubing guide mount 306, or another suitable surface, at an anchoring end via an anchoring pin 318. For example, the anchoring end 316 may have a curved profile configured to engage the anchoring pin 318 such that the spring 308 may leverage against the anchoring pin as it is loaded by the clamp 310. At an opposing end of the spring 308, an eyelet thumb 320 may allow for attachment to the clamp 310. For example, the eyelet thumb 320 may be configured to receive a bolt or pin 322 for coupling the spring 308 to the clamp 310.

The clamp 310 may generally be a screw clamp, having an attachment portion 324, a receiving portion 314, and an insertion portion 312. The attachment portion 324 may be configured to couple the clamp 310 to the mount 306 or another suitable structure or surface. The attachment portion 324 may additionally provide leverage against which the insertion portion 312 may act to pull the receiving portion 314. The receiving portion 314 may be configured to couple to the spring 308 via the eyelet thumb 320 with the bolt 322 or another suitable mechanism. The receiving portion 314 may be configured to receive the insertion portion 312, and may additionally be configured to engage with the insertion portion to lock the receiving portion in a fixed position relative to insertion portion. For example, in some embodiments, the receiving portion 314 may have an opening therein with internal threading configured to engage with external threading of the insertion portion 312. The insertion portion 312 may have a shaft configured to extend through the attachment portion 324 and into the receiving portion 314. The insertion portion 312 may have external threading configured to engage with the internal threading of the receiving portion 314, for example. The insertion portion 312 may have a handle 326, such that an operator may turn the turn the handle to engage the threading between the insertion and receiving 314 portions, thereby pulling the receiving portion and the spring 308 toward to the attachment portion 324 to load the spring. One or more washers 328 may be arranged between the insertion portion 312 and attachment portion 324. Additionally, an operator may loosen or release the clamp 310, and thus the spring 308, by unscrewing the insertion portion 312 from the receiving portion 314. It is to be appreciated that in other embodiments, the insertion portion 312 and receiving portion 314 may be reversed. That is, the spring 308 may couple to a threaded shaft, and the handle 326 may be coupled to a receiving portion with internal threading configured to receive the shaft, for example. Moreover, in some embodiments, the receiving portion 314 and insertion portion 312 may engage one another using other suitable engaging or attachment mechanisms.

Figure 8:
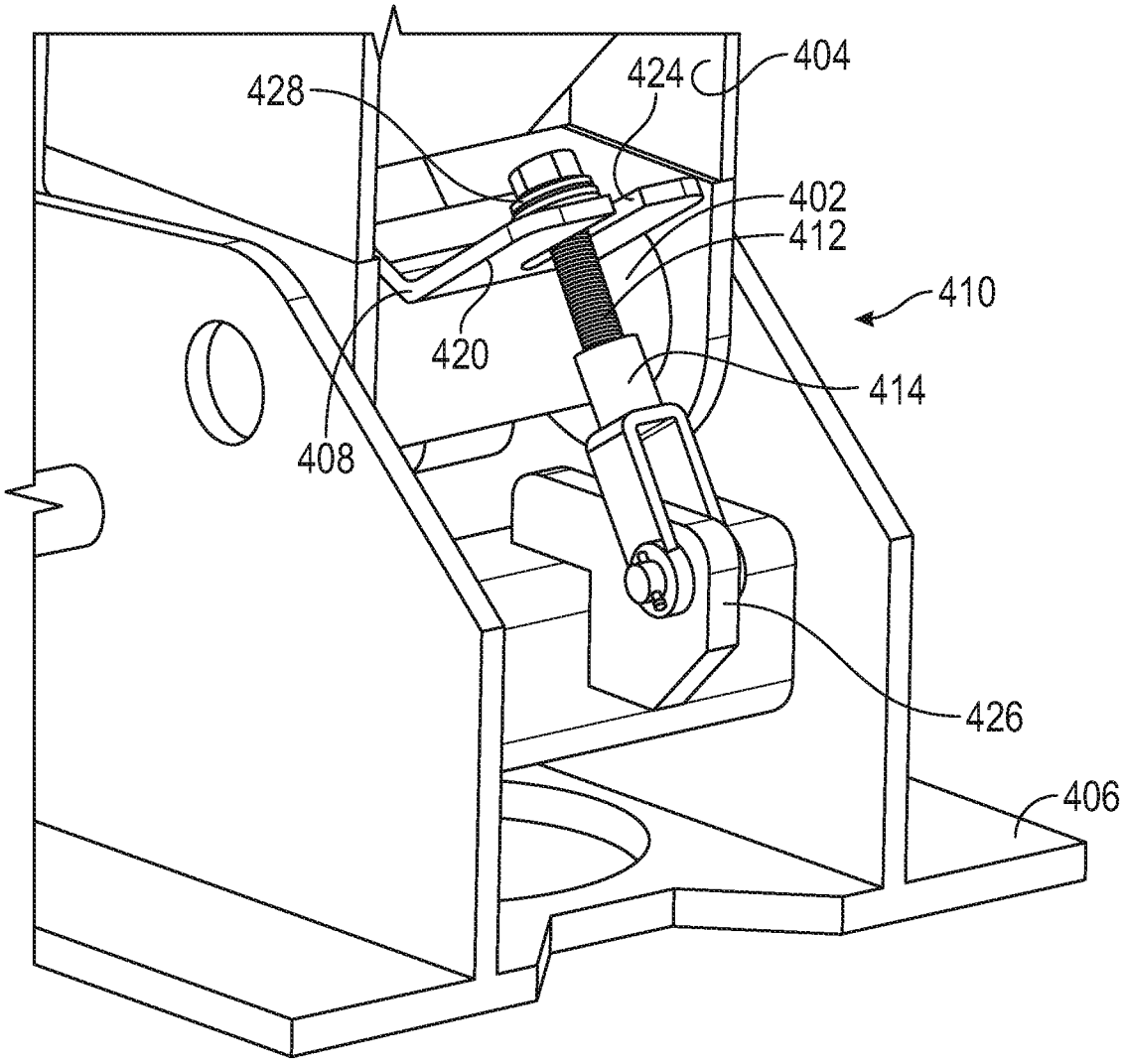
FIG. 8 is a perspective view of a clamping mechanism at a pinned connection between a coiled tubing guide and a tubing guide mount, according to one or more embodiments.
Figure 9:
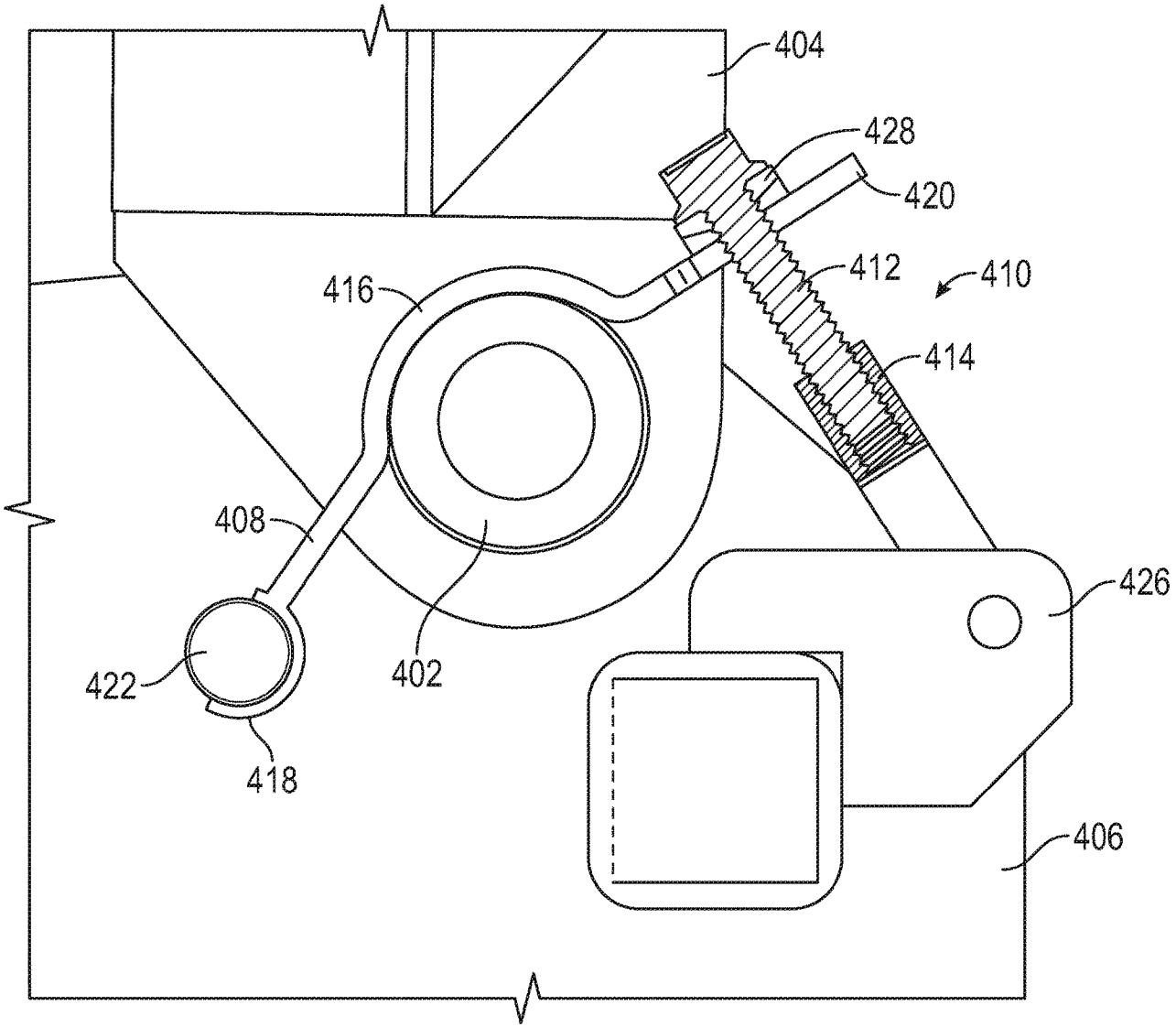
FIG. 9 is a cross sectional view of the clamping mechanism of FIG. 8, according to one or more embodiments.

Turning now to FIGS. 8 and 9, another mechanism for preloading the pin is shown, according to one or more embodiments. As similarly described with respect to FIGS. 8 and 9, a pin may operate to connect a tubing guide 404 to a tubing guide mount 406, or alternatively to another structure or surface proximate to the tubing injector. The tubing guide 404 may have a sleeve 402 configured to receive the pin. A plate spring 408 may be configured to preload the sleeve 402 and/or pin to reduce or resist play or excess movement at the pinned connection. A clamp 410 having an insertion portion 412 and a receiving portion 414 may operate to load the plate spring 408.

The plate spring 408 may be similar to the plate spring described with respect to FIGS. 4 and 5. That is, the plate spring 408 may generally have a flattened plate-like shape and may be configured to curve around a portion of the sleeve 402 to effectively withstand rotational forces on the guide 404 and/or pin caused by coiled tubing operations. In some embodiments, rather than a continuous curve or arc between first and second ends, the spring 408 may have centrally arranged arc 416 configured to curve around the sleeve 402, and two flanges extending from each end of the arc to form the first 418 and second 420 ends of the spring. The first end 418 may couple the spring to the tubing guide mount 406, or another suitable surface, at the first end via an anchoring pin 422. The second end 420 of the spring 408 may have an opening 424 configured to allow for attachment to the clamp 410. For example, the opening 424 may be a U-shaped opening configured to receive a bolt of the clamp 410. Alternatively, the opening 424 may be a circular or other shaped opening in other embodiments.

The clamp 410 may generally be a bolted connection have an attachment portion 426, a receiving portion 414, and an insertion portion 412. The attachment portion 426 may be configured to couple the clamp 410 to the tubing guide mount 406 or another suitable structure or surface. The receiving portion 414 may couple to the attachment portion 426, and may be configured to receive the insertion portion 412. The receiving portion 414 may additionally be configured to engage with the insertion portion 412 to lock the insertion portion in a fixed position relative to receiving portion. For example, in some embodiments, the receiving portion 414 may have an opening therein with internal threading configured to engage with external threading of the insertion portion 412. The insertion portion 412 may have a shaft configured to extend through the opening 424 of the spring 408 and into the receiving portion 414. The insertion portion 412 may have external threading configured to engage with the internal threading of the receiving portion 414, for example. In some embodiments, the insertion portion 412 may be or include a threaded bolt, such as a hex bolt. One or more washers 428 may be arranged about the opening 424 in the spring 408. An operator may screw the insertion portion 412 into the receiving portion 414 to tighten the clamp 410, and thus load the spring 408 against the sleeve 402. Similarly, an operator may release or unload the spring 408 by unscrewing the insertion portion 412 from the receiving portion 414. It is to be appreciated that in other embodiments, the insertion portion 412 and receiving portion 414 may be reversed. Moreover, in some embodiments, the receiving portion 414 and insertion portion 412 may engage one another using other suitable engaging or attachment mechanisms.

It is to be appreciated that alternative to, or in addition to, the mechanisms described above, other mechanisms may be used to preload the pinned connection between the tubing guide and tubing guide mount so as to mitigate movement at the connection. These various mechanisms may use one or more plate springs and/or other mechanisms. For example, in some embodiments, a plate spring or leaf spring may be arranged around the pin sleeve of the tubing guide, similar to the springs described above. However, both ends of the spring may be coupled to a mounting plate arranged on one side of the pin sleeve. For example, one or more bolts or screws may couple the spring to the mounting plate. The bolts or screws may be tightened to apply a load on the sleeve. In some embodiments, one end of the spring may be coupled to the mounting plate via a hinge, such as a pin hinge. Tightening of a bolt or screw at the opposing end of the spring and mounting plate may apply the load to the sleeve. In some embodiments, an eyelet or sheath may be arranged around the pin sleeve. The eyelet or sheath may be coupled to an arm. The arm may extend through a mount arranged on one side of the pin sleeve. In some embodiments, the eyelet or sheath may tightened against the mount by a threaded nut arranged on an opposing side of the mount. In some embodiments, a spring may be arranged along the arm, such as between the mount and eyelet or sheath. As the arm is rotated into position, the spring may become loaded and develop the tension in the arm and the desired force on the pin sleeve. In some embodiments, a tensioned belt, band, strap, or cable may be used to apply a force to the pin sleeve. For example, a winch may be mounted to the tubing guide or to the tubing guide mount, for example, and may be used to tighten a strap arranged about the pin sleeve. The strap may be fixed at one end and may be directed by one or more sheaves. In some embodiments, a belt or band may be arranged in a loop around the pin sleeve and another pin. An in-line cam, oval-shaped pin, link, or other device may be used to tighten the belt or band. In some embodiments, a push down arm or lever arm may be configured to be tightened against the pin sleeve by a clamp, one or more bolts or screws, and/or one or more springs. In some embodiments, a rotating cam with a dog may be arranged on the pin sleeve and may be rotated to apply a force to the pin sleeve. In some embodiments, a pipe clamp may be arranged on the pin sleeve. A mounting plate may be arranged against the pipe clamp, and one or more bolts or screws may be used to tighten the mounting plate against the pipe clamp. In some embodiments, the pinned connection may be braced. For example, a pair of side bumpers may be arranged on either side of the tubing guide. For example, side bumpers may be arranged outside of two mounting ears of the tubing guide mount through which the pin extends. The bumpers may be tightened against the mounting ears and/or against the tubing guide to brace the pinned connection to reduce play in the connection.

In still other embodiments, other mechanisms that may be used instead of or in addition to some of those described above include coil springs, conical springs, leaf springs, Belleville washers, spring plungers, ball plungers, hinges, U-bolts, eyelet bolts, magnets, cams wheels, wenches, cables, straps, belts, loops, chains, sheaves, levers, and/or other suitable mechanisms. In general, any suitable mechanism(s) may be used to preload, or clamp down on, the pin. Moreover, while the mechanisms above have been described with respect to three separate embodiments, components from these different embodiments may be combined in various combinations.

It is to be further appreciated that the various mechanical clamping, anchoring, bracing, and other solutions provided herein may generally provide for low-cost and durable means for stabilizing a tubing guide, while providing for ease of assembly and disassembly of the unit and consideration of safety concerns. The mechanisms described herein may additionally be generally easily retrofitted and installed. Moreover, the mechanisms described herein may generally be implemented without the addition of small or loose components that may potentially interfere with injector operation.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A coiled tubing unit for servicing an oil well, the unit comprising:

a coiled tubing injector;

a coiled tubing guide arranged proximate to the injector and configured to direct tubing from a reel and into the injector, wherein the coiled tubing guide is coupled to the coiled tubing injector by a pinned connection with a pin extending laterally relative to a line of motion of the tubing and establishing a pivoting connection between the coiled tubing guide and the coiled tubing injector; and a clamping mechanism arranged and configured to apply a substantially lateral load on the pinned connection to reduce play in the pinned connection.

2. The coiled tubing unit of claim 1, wherein the coiled tubing guide comprises a sleeve configured to receive the pin, and wherein the clamping mechanism is configured to apply the substantially lateral load on the sleeve.

3. The coiled tubing unit of claim 1, wherein the clamping mechanism comprises a plate spring.

4. The coiled tubing unit of claim 3, wherein the clamping mechanism further comprises a clamping plate and a tensioning handle pivotably coupled to the clamping plate.

5. The coiled tubing unit of claim 4, wherein the plate spring is anchored at a first end.

6. The coiled tubing unit of claim 5, wherein the plate spring is coupled at a second end to the tensioning handle.

7. The coiled tubing unit of claim 3, wherein the clamping mechanism further comprises a threaded clamp.

8. The coiled tubing unit of claim 1, wherein the coiled tubing injector is arranged in an injector frame, and wherein the coiled tubing guide is coupled by the pin to a mount arranged on the injector frame.

9. The coiled tubing unit of claim 1, wherein the clamping mechanism comprises at least one of:

a spring, a clamp; a belt, a cable, a cam, a lever; and a pair of bumpers.

10. A method of reducing lateral movement of a coiled tubing guide, wherein the coiled tubing guide is coupled to a coiled tubing injector by a pinned connection with a pin extending laterally relative to a line of motion of tubing being directed through the tubing guide and establishing a pivoting connection between the coiled tubing guide and the coiled tubing injector, the method comprising:

positioning a clamping mechanism over the pinned connection; and applying a substantially lateral load on the pinned connection to reduce play in the pinned connection.

11. The method of claim 10, wherein positioning a clamping mechanism over the pinned connection comprises:

positioning a plate spring over the pinned connection; and coupling the plate spring to a clamp; and applying a substantially lateral load comprises tightening the clamp to apply a force on the pinned connection.

12. The method of claim 11, wherein the pinned connection comprises the pin arranged through a sleeve of the tubing guide, and wherein the plate spring is arranged over the sleeve.

13. The method of claim 10, wherein the clamping mechanism comprises a plate spring, a clamping plate, and a tensioning handle pivotably coupled to the clamping plate.

14. The method of claim 10, wherein the clamping mechanism comprises a plate spring and a threaded clamp.

15. A clamping mechanism for reducing lateral movement of a coiled tubing guide, wherein the coiled tubing guide is coupled to a coiled tubing injector by a pinned connection with a pin extending laterally relative to a line of motion of tubing being directed through the tubing guide and establishing a pivoting connection between the coiled tubing guide and the coiled tubing injector, the mechanism comprising:

a spring extending over the pinned connection; and a clamp coupled to the spring and configured to tighten the spring so as to apply a substantially lateral load on the pinned connection to reduce play in the pinned connection.

16. The clamping mechanism of claim 15, wherein the coiled tubing guide comprises a sleeve configured to receive the pin, and wherein the clamping mechanism is configured to apply the substantially lateral load on the sleeve.

17. The clamping mechanism of claim 15, wherein the spring is a plate spring.

18. The clamping mechanism of claim 17, wherein the clamp comprises a clamping plate and a tensioning handle pivotably coupled to the clamping plate.

19. The coiled tubing unit of claim 17, wherein the clamp is a threaded clamp.

20. The clamping mechanism of claim 15, wherein the spring is anchored at a first end by an anchoring pin, and is coupled at a second end to the clamp.

* * * * *